US008978517B2

(12) United States Patent
Meyers et al.

(10) Patent No.: US 8,978,517 B2
(45) Date of Patent: Mar. 17, 2015

(54) HANDHELD ELECTRIC CAPPER AND DECAPPER

(75) Inventors: Christopher J. Meyers, Bridgeton, NJ (US); Craig Platania, Vineland, NJ (US)

(73) Assignee: Wheaton Industries, Inc., Millville, NJ (US)

( * ) Notice: Subject to any disclaimer, the term of this patent is extended or adjusted under 35 U.S.C. 154(b) by 1103 days.

(21) Appl. No.: 13/002,791

(22) PCT Filed: Jul. 9, 2009

(86) PCT No.: PCT/US2009/050042

§ 371 (c)(1), (2), (4) Date: Mar. 1, 2011

(87) PCT Pub. No.: WO2010/006120

PCT Pub. Date: Jan. 14, 2010

(65) Prior Publication Data

US 2011/0138967 A1 Jun. 16, 2011

Related U.S. Application Data

(60) Provisional application No. 61/079,207, filed on Jul. 9, 2008.

(51) Int. Cl.

| | |
|---|---|
| ***B67B 7/00*** | (2006.01) |
| ***B67B 3/14*** | (2006.01) |
| ***B25B 21/00*** | (2006.01) |
| ***B25B 17/00*** | (2006.01) |
| ***B67B 7/16*** | (2006.01) |
| *B25B 17/02* | (2006.01) |

(52) U.S. Cl.

CPC . *B67B 3/14* (2013.01); *B25B 21/00* (2013.01); *B25B 17/00* (2013.01); *B67B 7/164* (2013.01); *B25B 21/002* (2013.01); *B25B 17/02* (2013.01)

USPC ..... 81/3.2; 53/75

(58) Field of Classification Search

CPC ..... B25B 17/00; B25B 17/02; B25B 21/00; B25B 21/002

USPC ..... 81/3.2, 57, 57.14; 279/110, 123, 124, 279/900, 301

See application file for complete search history.

(56) References Cited

U.S. PATENT DOCUMENTS

| | | | | |
|---|---|---|---|---|
| 4,653,358 | A * | 3/1987 | Lankry | 81/474 |
| 6,076,330 | A * | 6/2000 | Thomas et al. | 53/75 |
| 6,196,045 | B1 | 3/2001 | Thomas et al. | |
| 2004/0074025 | A1 * | 4/2004 | Blaustein et al. | 15/23 |

FOREIGN PATENT DOCUMENTS

| | | |
|---|---|---|
| EP | 1 157 965 | 11/2001 |
| GB | 726 527 | 3/1955 |
| GB | 2 359 069 | 8/2001 |
| WO | WO 97/03790 | 2/1997 |

OTHER PUBLICATIONS

International Search Report for PCT/US2009/050042 mailed Oct. 8, 2009.

* cited by examiner

*Primary Examiner* — Monica Carter
*Assistant Examiner* — Melanie Alexander
(74) *Attorney, Agent, or Firm* — RatnerPrestia

(57) ABSTRACT

A hand tool (10) for capping or removing a cap from a container. The tool comprises a housing assembly (20) and a gearbox assembly (200) positioned within the housing assembly. The gearbox assembly includes a motor (42), a lead screw (70) rotated by the motor and a screw pusher (90) engaged by the lead screw and moved axially based on rotation of the lead screw. The gearbox assembly is adapted to engage a jaw set assembly (200) with the screw pusher operatively engaging a jaw set of the jaw set assembly.

14 Claims, 19 Drawing Sheets

HANDHELD ELECTRIC CAPPER AND DECAPPER

CROSS REFERENCE TO RELATED APPLICATIONS

This application is the U.S. national phase application of PCT International Application No. PCT/US2009/050042, filed Jul. 9, 2009, which claims priority to U.S. Provisional Patent Application No. 61/079,207, filed Jul. 9, 2008, the contents of such applications being incorporated herein by reference.

BACKGROUND OF THE INVENTION

1. Field of the Invention

The present invention relates to a powered hand tool used to secure or remove a cap on a bottle or vial. The hand tool has a housing portion which the user holds and includes switches for the user to control the capping/decapping action. The capping action results from a motor causing a plunger to move downward, thereby actuating a plurality of jaws to secure the cap on the bottle or vial.

2. Description of the Prior Art

Some bottles or vials to contain liquid samples or other laboratory materials have an opening thereinto which includes a lip onto which a cap is crimped to seal the bottle or vial. In general, for example, the crimp cap can be aluminum or steel, with sample diameters of from about 8 mm to about 22 mm, or greater. Typically the crimp cap has a cylindrical portion which fits over the bottle lip and is then crimped thereunder; the crimp cap has a top with a circular opening therein; the inside of the crimp cap contains a rubber circular portion next to the crimp cap and an elastomeric circular portion next to the bottle, although many variations are known. In use, a sample is placed into the bottle or vial and a crimp cap is placed thereon. A crimping tool is then employed to crimp the crimp cap onto the bottle. When a portion of the sample is to be removed, a syringe is inserted through the rubber and elastomeric circular portions and the desired amount of the sample is removed.

Alternatively, there are a number of bottle capping machines currently used to apply screw caps onto bottles. In general such machines employ a reciprocating mechanism to reciprocate a screw cap applying spindle assembly through a capping cycle. A screw cap chuck, typically constructed of a tool grade steel, is attached to the spindle. These machines operate at a predetermined downward stroke while applying a pre-determined torque to the screw cap. An example of such an apparatus is shown in U.S. Pat. No. 3,031,822, which is incorporated herein by reference.

SUMMARY OF THE INVENTION

The present invention provides in at least one embodiment a hand tool for capping or removing a cap from a container. The tool comprises a housing and a gearbox assembly positioned within the housing. The gearbox assembly includes a motor, a lead screw rotated by the motor and a screw pusher engaged by the lead screw and moved axially based on rotation of the lead screw. The gearbox assembly is adapted to engage a jaw set assembly with the screw pusher operatively engaging a jaw set of the jaw set assembly.

In at least one embodiment, the housing has a central axis and a hand grip area is defined about the central axis of the housing. Furthermore, the gearbox assembly has a drive axis that extends substantially coaxial with the central axis.

In at least one embodiment, the gearbox assembly is adapted to engage jaw set assemblies having different configurations and the hand tool further comprises a sensor assembly configured to sense the configuration of an engaged jaw set assembly and control the motor and a stroke of the lead screw based thereon.

In at least one embodiment, the hand tool further comprises a sensor configured to determine if a jaw set assembly is engaged with the gearbox assembly.

DETAILED DESCRIPTION OF THE INVENTION

Figure 1:
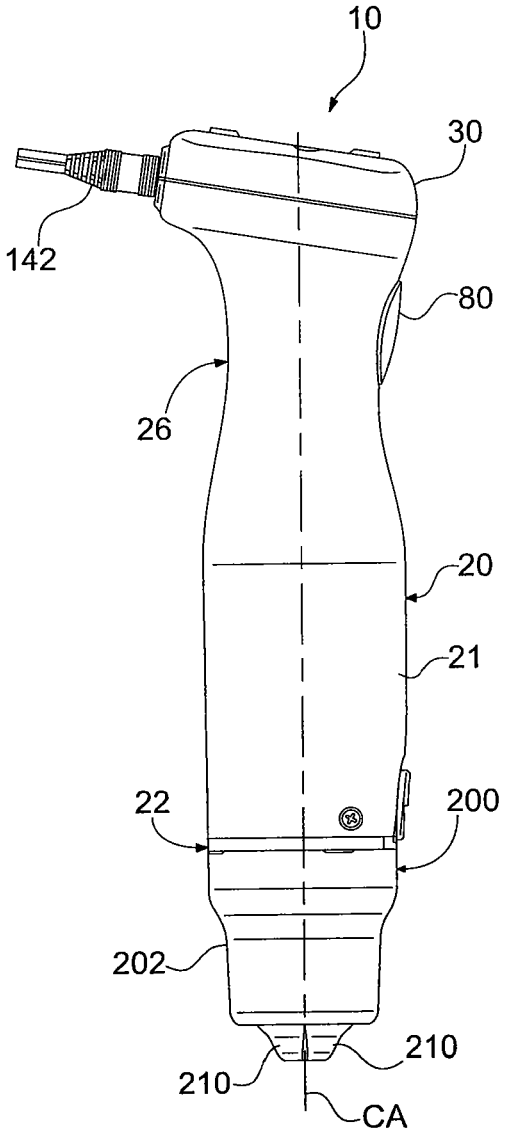
FIG. 1 is a right elevation view of an electric hand tool in accordance with an embodiment of the present invention.
Figure 2:
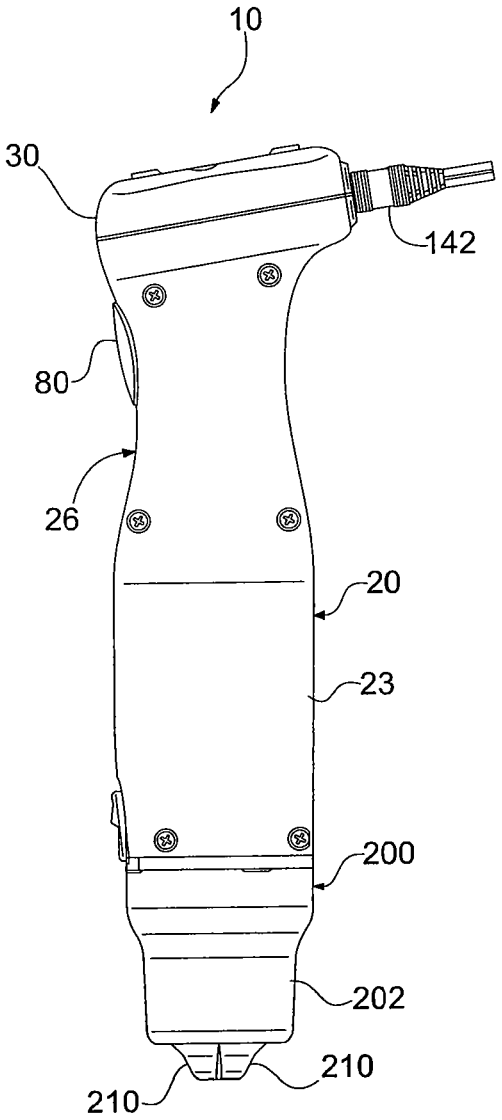
FIG. 2 is a left elevation view of the electric hand tool of FIG. 1.
Figure 3:
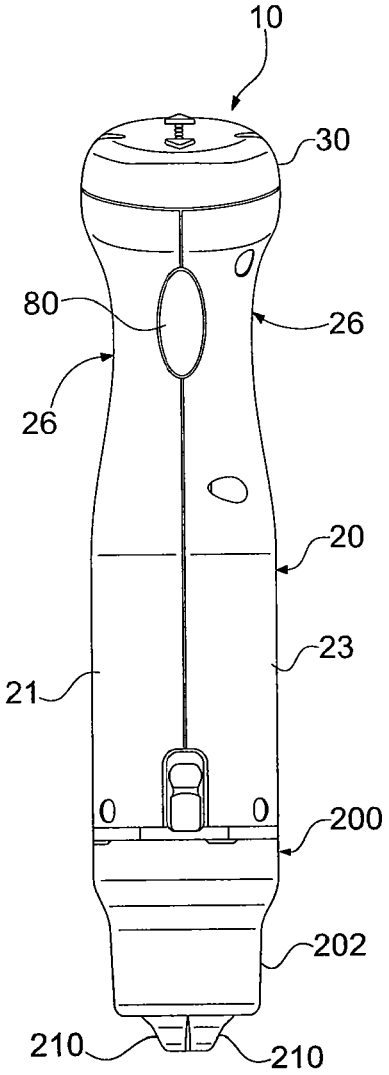
FIG. 3 is a front elevation view of the electric hand tool of FIG. 1.
Figure 4:
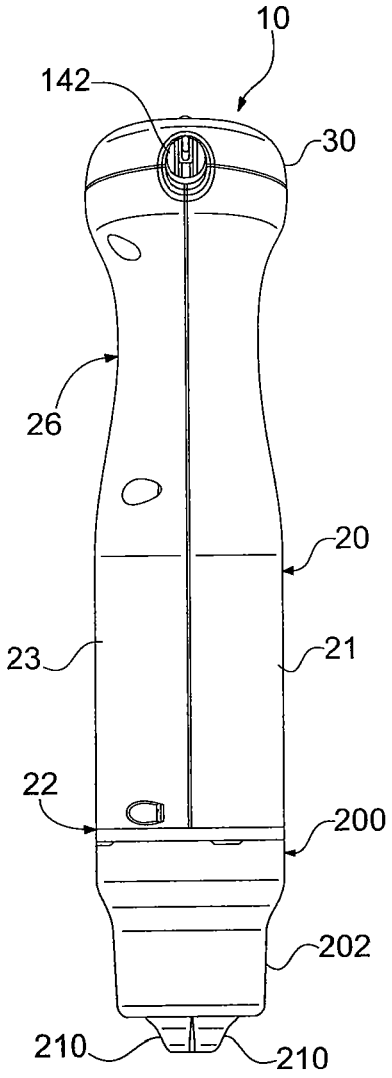
FIG. 4 is a rear elevation view of the electric hand tool of FIG. 1.
Figure 5:
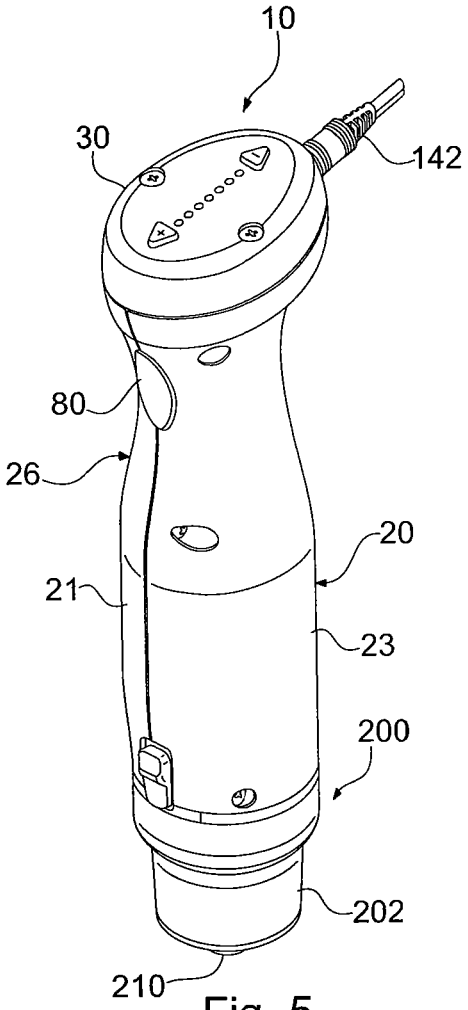
FIG. 5 is an isometric view of the electric hand tool of FIG. 1.
Figure 6:
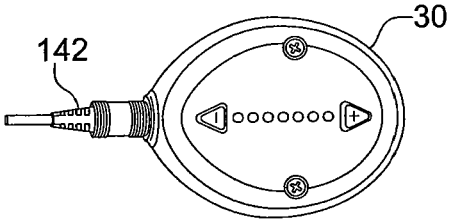
FIG. 6 is a top plan view of the electric hand tool of FIG. 1.
Figure 7:
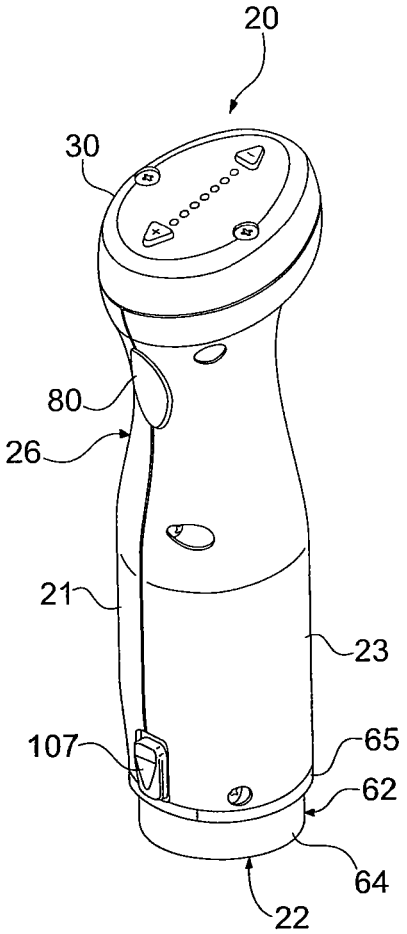
FIG. 7 is an isometric view of the housing assembly of the electric hand tool of FIG. 1.

An electric hand tool 10 in accordance with a first embodiment of the present invention will be described with reference to FIGS. 1-31. Referring to FIGS. 1-8, the electric hand tool 10 generally comprises a housing assembly 20 to which are connected interchangeable jaw set assemblies 200. Each jaw set assembly 200 includes a jaw set housing 202 configured for connection to a pusher end 22 of the housing assembly 20. As illustrated in FIGS. 1-5, a plurality of jaw members 210 extend from the jaw set housing 202. The jaw members 210 are pivotally supported within the jaw set housing 202 in a known manner such that they may pivoted between open and closed positions in response to engagement by a pusher screw in a known manner. The jaw members 210 may be configured for use in crimping a crimp cap (not shown) upon a vial or bottle (not shown) or may be configured for decapping of a vial or bottle. Alternatively, the jaw set assembly 200 may be configured as a screw cap chuck such that the jaw members 210 grip the cap while a capping or decapping torque is applied thereto. Various configurations of jaw members 210 are known and may be utilized with the present invention. It is desirable that a plurality of differently configured jaw set assemblies 200 are interchangeably connectable to the housing assembly 20. For example, jaw set assemblies 200 for capping and decapping bottles of various sizes may be provided.

Figure 8:
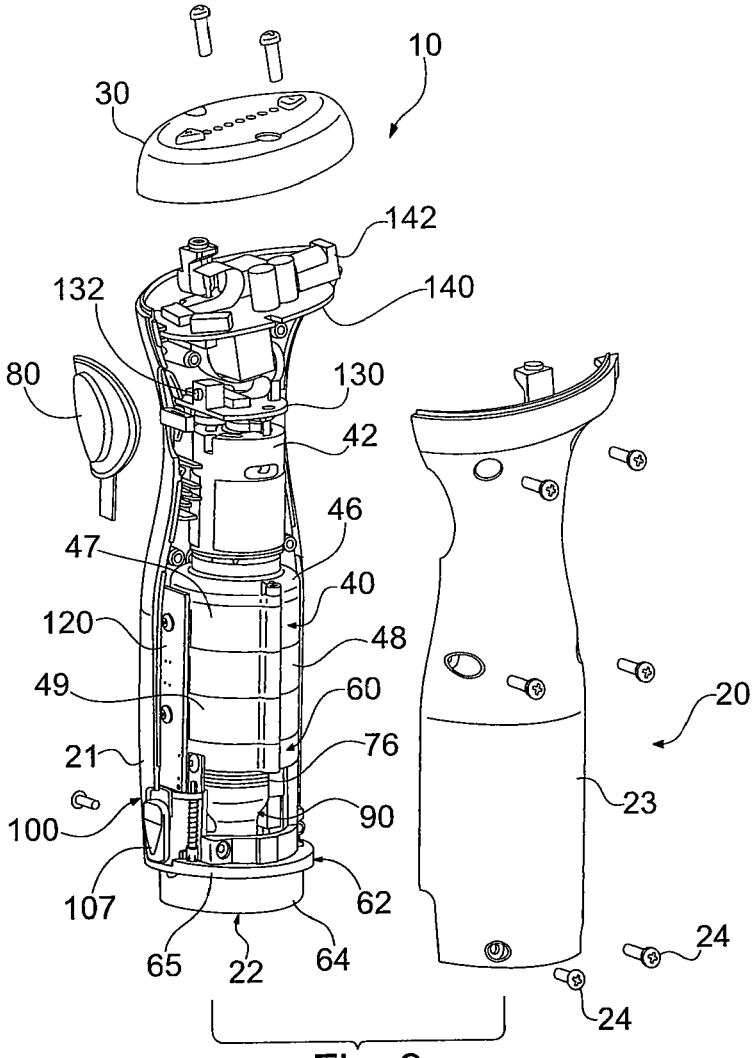
FIG. 8 is a partial exploded view of the housing assembly of FIG. 7.

In the present embodiment, the housing assembly 20 is defined by opposed housing shell components 21 and 23 (see FIG. 8). The housing shell components 21 and 23 may be connected by screws 24 or any other suitable means. As shown in FIG. 8, a lower frame 62 is secured between the housing shell members 21 and 23 and defines the pusher end 22 of the housing assembly 20. At the opposite end, a top cap 30 is positioned about and connected to the opposed housing shell members 21 and 23, thereby closing the end of the housing assembly 20. While the housing assembly 20 described herein has a clamshell configuration, other configurations may also be utilized.

As illustrated in FIG. 1, the hand tool 10 generally extends along a central axis CA. In the present embodiment, the housing assembly 20 defines a handle area 26 proximate to the top cap 30 end of the housing assembly 20 and extending about the central axis CA. The handle area 26 in the present embodiment has a reduced circumference. The activation button 80 for activating the motor as described hereinafter is positioned within or adjacent to the handle area 26. In this manner, a user may hold the hand tool 10 about the central axis CA, providing an ergonomic, balanced configuration for operation of the tool. While the handle area 26 extends about the central axis CA, the utility of the invention is not limited to the specific configuration of the housing assembly 20 illustrated herein and may be achieved using other configurations having a different ornamental appearance.

Figure 9:
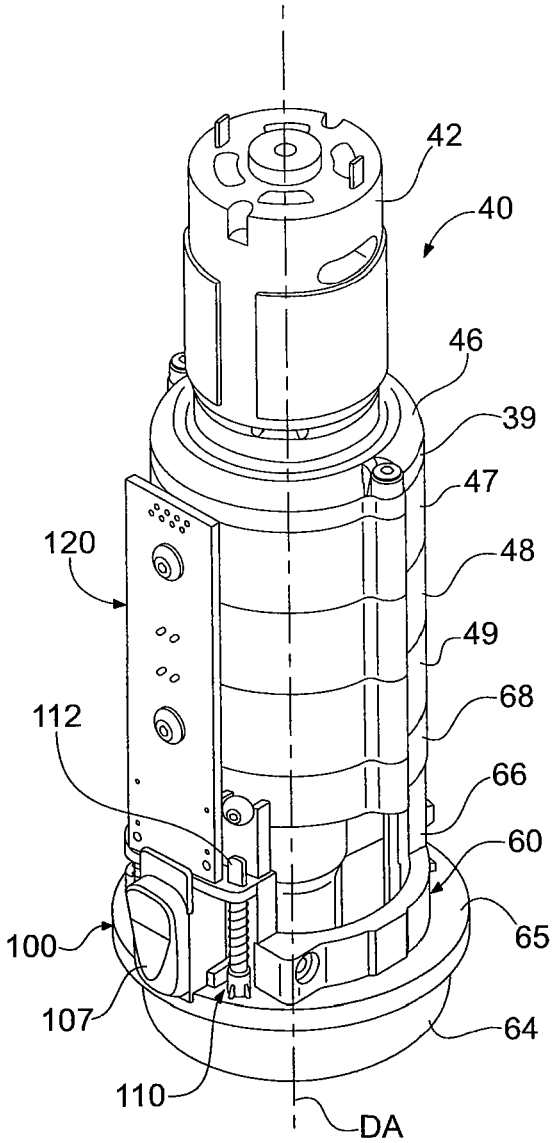
FIG. 9 is an isometric view of the gearbox assembly of the electric hand tool of FIG. 1.
Figure 10:
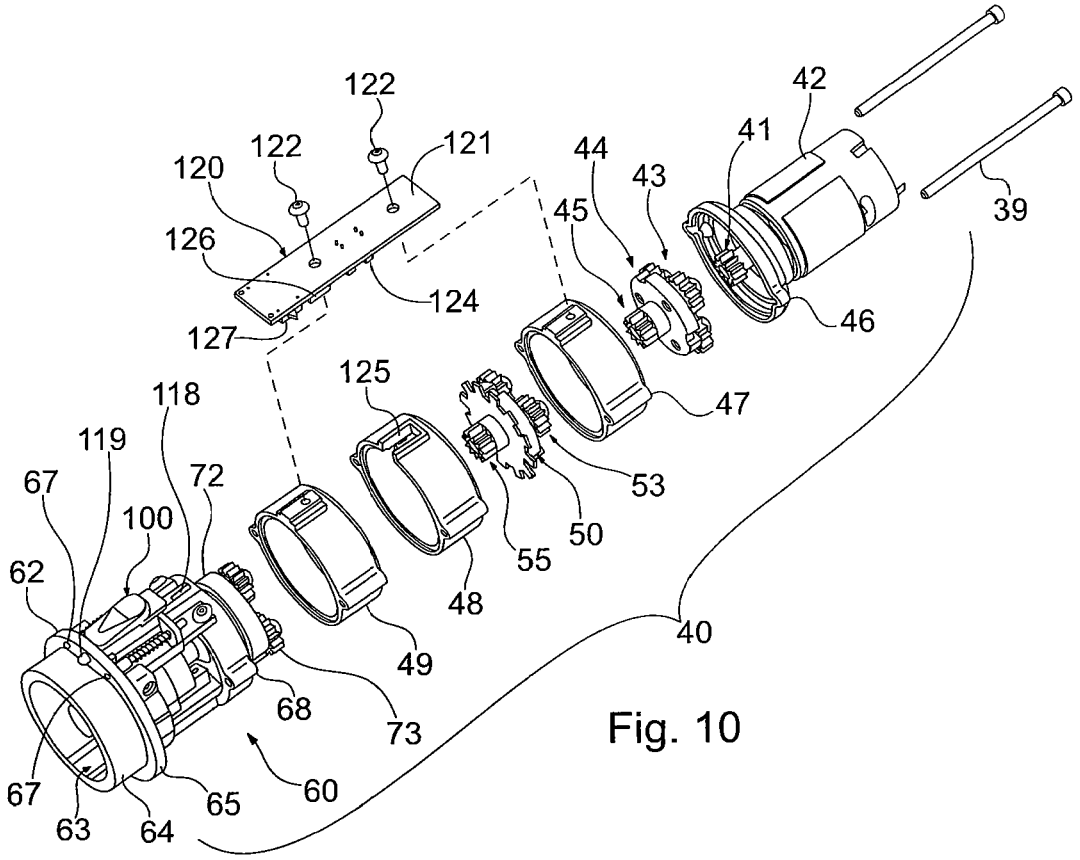
FIG. 10 is a partial exploded view of the gearbox assembly of FIG. 9.

Referring to FIGS. 8-10, a gearbox assembly 40 is secured within the housing assembly 10 and has a drive axis DA which preferably is substantially coaxial with the central axis CA. The gearbox assembly 40 generally includes a motor 42 supported relative to the lower frame assembly 60 with a series of gears therebetween. As shown in FIG. 10, an output gear 41 is provided on the output shaft of the motor 42. In the present embodiment, the output gear 41 engages a first series of planet gears 43 supported on a first carrier assembly 44. The first carrier assembly 44 in turn has an output planet carrier gear 45. The number and arrangement of the planet gears 43 and the output planet carrier gear 45 are configured to provide a desired gear ratio. The first carrier assembly 44 is positioned in a first frame member 47 which is configured to connect to a motor frame member 46 about the motor output gear 41.

Figure 14:
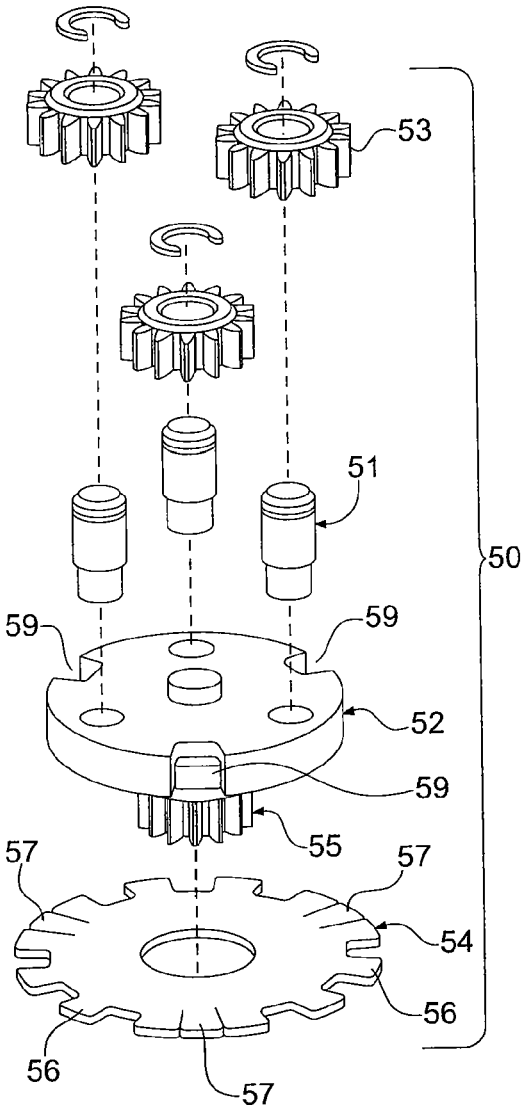
FIG. 14 is an exploded view of the sensor carrier assembly of the electric hand tool of FIG. 1.
Figure 15:
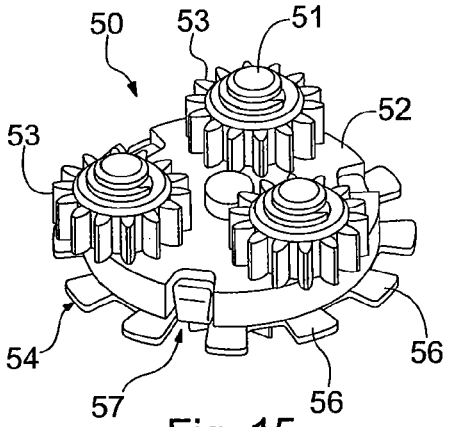
FIG. 15 is an isometric view the sensor carrier assembly of FIG. 14.

The output planet carrier gear 45 engages the planet gears 53 of a second, optical sensor carrier assembly 50. With reference to FIGS. 14 and 15, the optical sensor carrier assembly 50 is similar to the first carrier assembly 44, but further includes an encoder ring 54. As illustrated therein, a plurality of planet gears 53 are supported by planet gear pins 51 extending from the planet carrier 52. The opposite face of the planet carrier 52 has an output planet carrier gear 55 attached thereto. The number and arrangement of the planet gears 53 and the output planet carrier gear 55 are configured to provide a desired gear ratio. The encoder ring 54 is positioned about the output planet carrier gear 55 and includes a plurality of spaced apart radially extending teeth 56. Crimp tabs 57 extend between some of the teeth 56 and are configured to be crimped onto notches 59 in the planet carrier 52, as shown in FIG. 15, to retain the encoder ring 54 attached to the planet carrier 52. A sensor 124, as described hereinafter, is configured to monitor passage of the individual teeth 56, thereby facilitating monitoring the speed, direction, and position of rotation of the optical sensor carrier assembly 50. The optical sensor carrier assembly 50 is positioned in a second frame member 48 which is configured to connect to the first frame member 47. An opening 125 is provided through frame member 48 to facilitate passage of the sensor 124.

Figure 11:
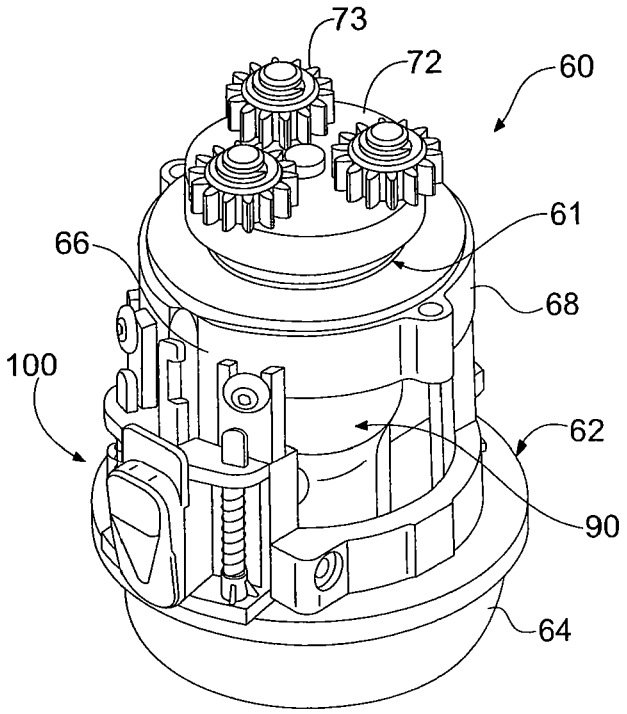
FIG. 11 is an isometric view of the lower frame assembly of the electric hand tool of FIG. 1.
Figure 12:
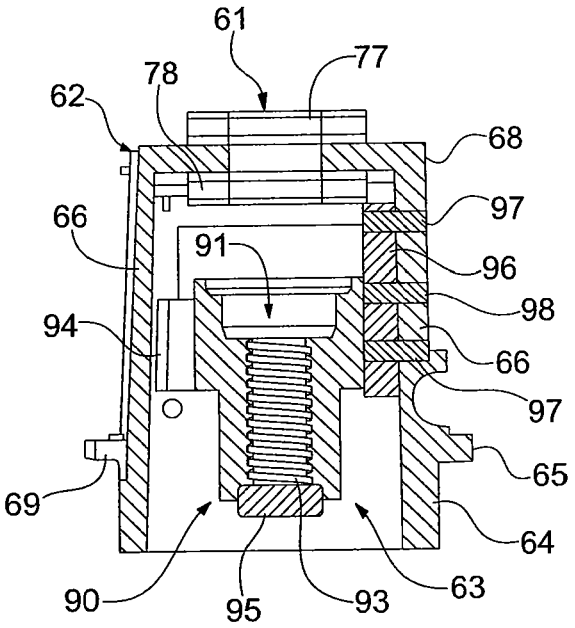
FIG. 12 is a cross-sectional view of the lower frame with the screw pusher assembled therein.
Figure 13:
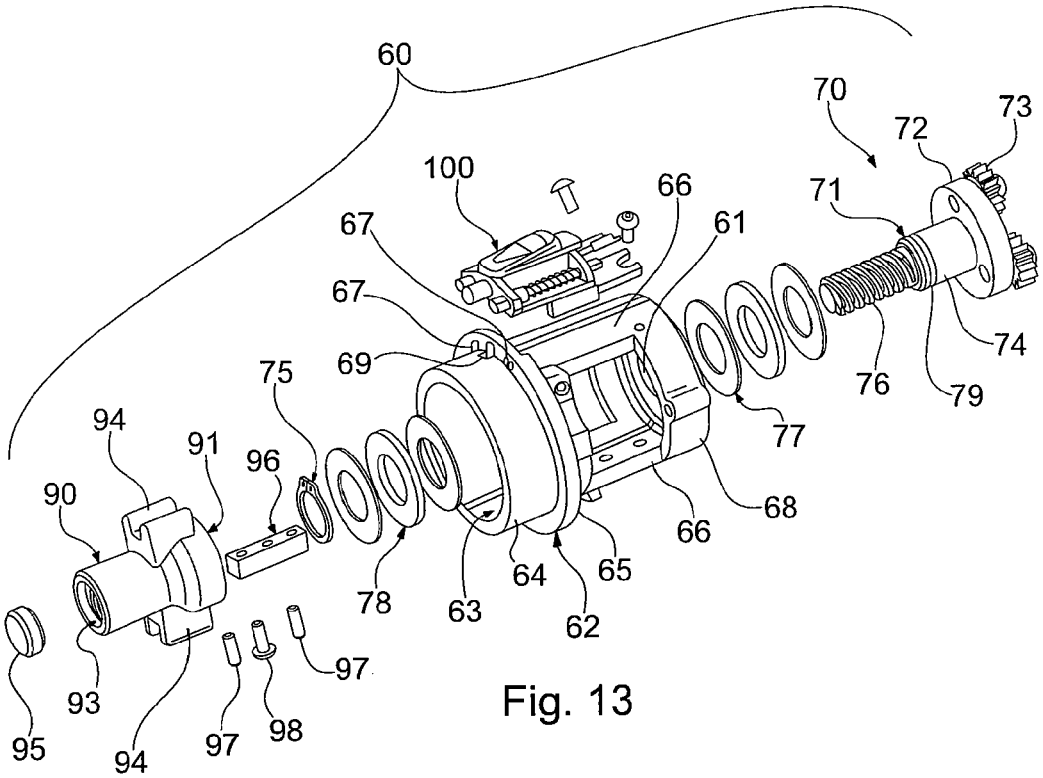
FIG. 13 is a partial exploded view of the lower frame assembly of FIG. 11.

The output planet carrier gear 55 is configured to engage the input planet gears 73 of the lead screw 70 which is part of the gearbox assembly 60. Referring to FIGS. 11-13, the gearbox assembly 60 includes the lower frame 62 which provides a generally hollow frame structure. The lower frame 62 includes upper portion 68 defining a first open end 61 and a lower portion 64 defining a second open end 63. Side rails 66 extend between the upper portion 68 and the lower portion 64. A shoulder 65 is defined about the lower portion 64 spaced from the open end 63. A lock rod opening 69 extends through the shoulder 65 with a sensor rod opening 67 on each side thereof. The lower portion 64 defines the pusher end 22 of the assembled housing assembly 20. The upper portion 68 is configured for attachment with a third frame member 49 that extends about the input planet gears 73. Referring to FIGS. 9 and 10, screws 39 or the like extend through the motor frame member 46, the frame members 47, 48 and 49, and engage the upper portion 68 of the lower frame 60, thereby interconnecting the gear box assembly 40.

Referring again to FIGS. 11-13, the lead screw 70 includes a planet head 72 with a shank 71 extending therefrom. In the present embodiment, a portion 74 of the shank 71 is non-threaded and a portion 76 of the shank 71 is threaded. The input planet gears 73 are rotatably supported on the planet head 72 and rotation of the input planet gears 73 causes the shank 71 to rotate based on the gear ratio therebetween. Accordingly, rotation of the motor 42 causes rotation of the lead screw shank 71 at a speed and direction based on the gear ratios of the first carrier assembly 44, the optical sensor carrier assembly 50 and the input planet gears 73. Rotation of the shank 71 can thereby be controlled by controlling the rotational output of the motor 42.

The lead screw shank 71 is positioned through the open end 61 of the lower frame 60 and the threaded portion 76 threadably engages the screw pusher 90 positioned within the lower frame 60. A series of washer and bearing members 77, 78 or the like may be provided between the lead screw 70 and the lower frame upper portion 68. Referring to FIGS. 12 and 13, the screw pusher 90 has an open end 91 leading to an internally threaded portion 93. The threaded portion 76 of the lead screw 70 threadably engages the internally threaded portion 93. A guide groove 94 extends from one or both sides of the screw pusher 90 and is configured to move along rail 96 to guide axial movement of the screw pusher 90. As illustrated in FIG. 12, the rail 96 may be secured to one of the side rails 66 via pins 97 and a screw 98, but may otherwise be connected or, alternatively, be formed integrally with the side rail 66. Engagement of the guide groove 94 with the rail 96 also prevents rotation of the screw pusher 90. As such, rotation of the lead screw 70 causes the screw pusher 90 to move axially upward or downward such that the screw pusher 90 engages the jaw set assembly 200 as desired to move the jaw members 210. A pusher tip 95 may be provided on the forward end of the screw pusher 90.

Figure 16:
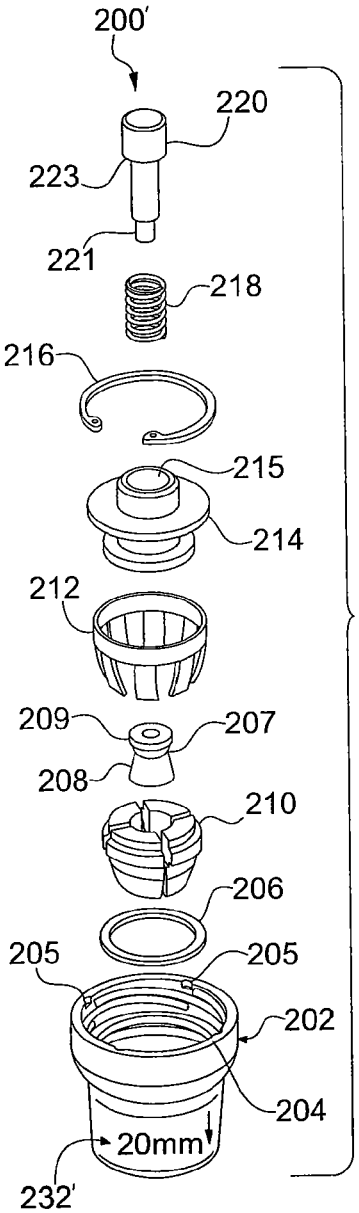
FIG. 16 is an exploded isometric view of an exemplary crimping jaw set assembly.
Figure 17:
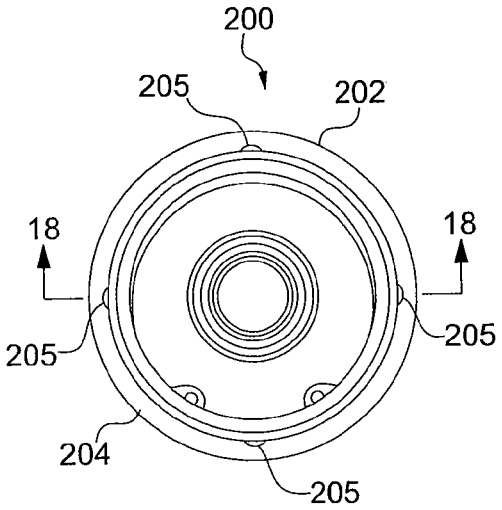
FIG. 17 is a top plan view of the crimping jaw set assembly of FIG. 16.
Figure 18:
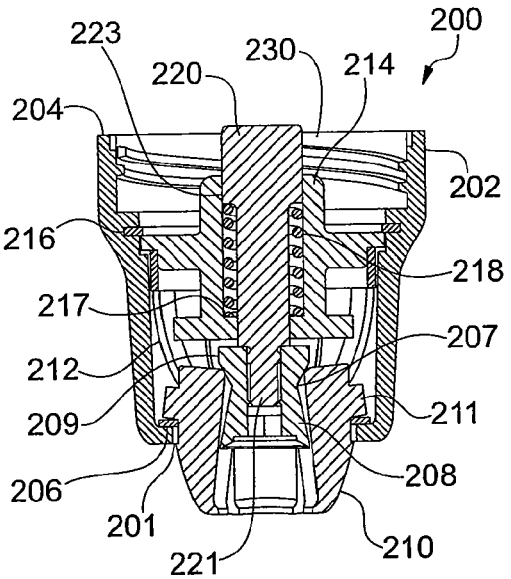
FIG. 18 is a cross-sectional view along the line 18-18 in FIG. 17.

Referring to FIGS. 16-18, a jaw set assembly 200' that is an exemplary crimping jaw set assembly will be described. The illustrated jaw set assembly 200' is configured to crimp a cap (not shown) on a bottle or vial, but can be alternatively be configured as a screw cap chuck for applying or removing a screw cap. Furthermore, while a specific jaw configuration is described herein, the invention is not limited to such and may utilize other configurations. The exemplary jaw set assembly 200' includes a housing 202' having a jaw opening 201 at one end and a connection opening 230 at the other end. As shown in FIG. 16, the external surface of the housing 202' desirably, but not necessarily, is provided with a visual indicia 232' of the configuration of the jaw set assembly 200'. For example, the indicia 232' shows "20 mm ↓" which would indicate that the current jaw set assembly 200' is a crimper (indicated by the arrow down) for a 20 mm vial. The specific configuration and location of the indicia 232' may be varied.

The connection opening 230 is configured for attachment to the lower frame 62. A rim 204 is defined about the connection opening 230 and is configured to abut against the shoulder 65 of the lower frame 62 upon connection of the jaw set assembly 200'. In the illustrated embodiment, the connection opening 230 has internal threads for a threaded connection to the lower frame, but other connection means may be utilized. The rim 204 includes at least one recess 205, four in the illustrated embodiment, configured to receive a portion of a lock rod 116 which helps to prevent inadvertent unscrewing of the jaw set assembly 200' as will be described hereinafter.

A portion of each jaw 210 extends through the jaw opening 201 with a jaw shoulder 211 abutting a jaw ring 206 to retain the jaws 210 in the housing 202'. The opposite ends of the jaws 210 are engaged by a biasing member 212 such that the jaws 210 are biased to the open position shown in FIG. 18. A cam member 208 is positioned within the jaws 210 and includes a tapered portion 207 and a contact portion 209. In the open position, the rear ends of the jaws 210 are axially aligned with the tapered portion 207 such that the rear ends are biased radially inward and the jaws 210 remain in the open position. Axial movement of the cam member 208 toward the jaw opening end of the housing 202' causes the contact portion 209 to contact the rear ends of the jaws 210 which causes the jaws 210 to pivot and bring the forward ends of the jaws 210 radially inward.

Axial movement of the cam member 208 is controlled by a plunger rod 220 having a forward end 221 connected to the cam member 208. In the illustrated embodiment, the forward end 221 is press fit into connection with the cam member 208, but other connection methods, for example, a threaded connection, may alternatively be utilized. A barrel 214 is positioned in the housing 202' and defines a stepped through bore 215 through which the plunger rod 220 extends. A spring 218 is positioned in the stepped through bore 215 between a forward shoulder 217 defined by the barrel 214 and a shoulder 223 defined by the plunger rod 220 such that the plunger rod 220, and thereby the cam member 208, are biased rearward. The barrel 214 is secured in the housing 202' via a retaining ring 216 or the like. The barrel 214 desirably closes the connection opening 230 except for the through bore 215 from which the plunger rod 220 extends. In this way, the jaw set assembly 200' provides a self-contained, interchangeable assembly with the actuating member, i.e. the plunger rod 220, easily accessible at the connection opening 230.

Figure 19:
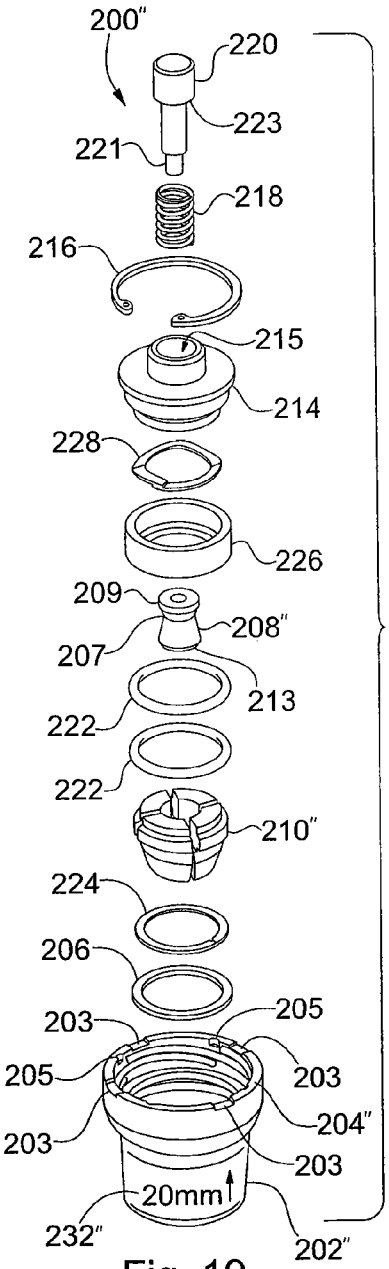
FIG. 19 is an exploded isometric view of an exemplary decapping jaw set assembly.
Figure 20:
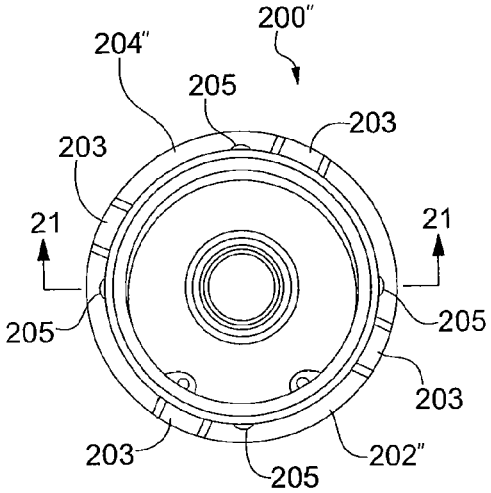
FIG. 20 is a top plan view of the decapping jaw set assembly of FIG. 19.
Figure 21:
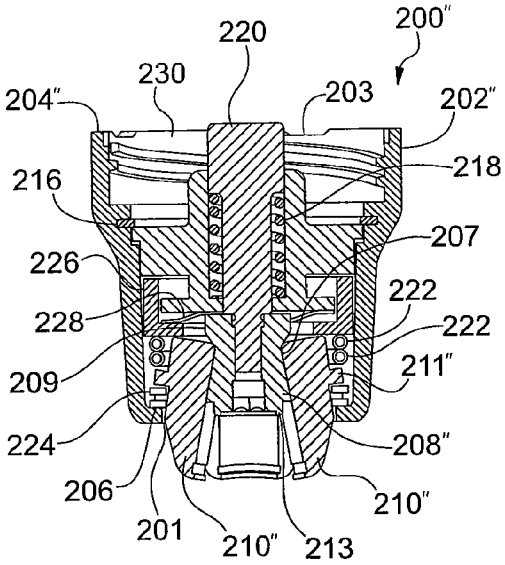
FIG. 21 is a cross-sectional view along the line 21-21 in FIG. 20.
Figure 22:
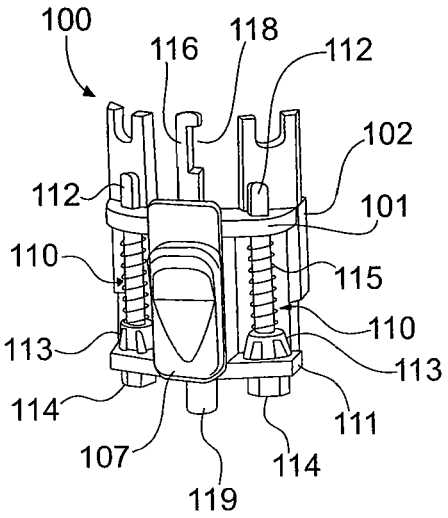
FIG. 22 is a front isometric view of the jaw sensor assembly of the electric hand tool of FIG. 1.
Figure 23:
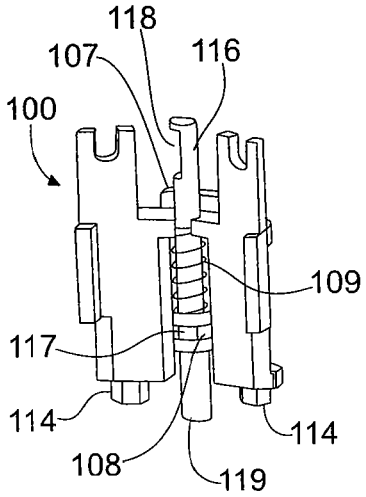
FIG. 23 is a rear isometric view of the jaw sensor assembly of FIG. 22.
Figure 24:
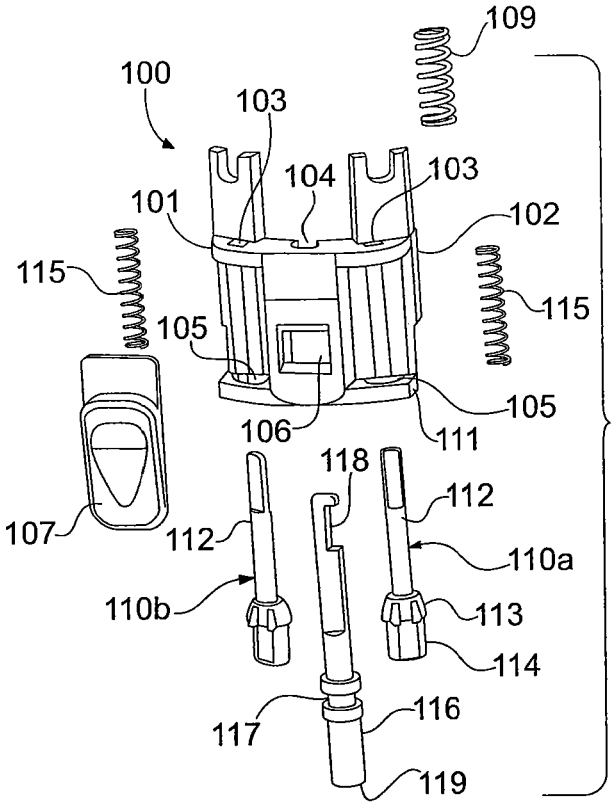
FIG. 24 is an exploded view of the jaw sensor assembly of FIG. 22.

Referring to FIGS. 19-21, a jaw set assembly 200" that is an exemplary decapping jaw set assembly will be described. While a specific jaw configuration is described herein, the invention is not limited to such and may utilize other configurations. The exemplary jaw set assembly 200" includes a housing 202" having a jaw opening 201 at one end and a connection opening 230 at the other end. As shown in FIG. 19, the external surface of the housing 202" desirably, but not necessarily, is provided with a visual indicia 232" of the configuration of the jaw set assembly 200". For example, the indicia 232" shows "20 mm ↑" which would indicate that the current jaw set assembly 200' is a decapper (indicated by the arrow up) for a 20 mm vial. The specific configuration and location of the indicia 232" may be varied.

The connection opening 230 is configured for attachment to the lower frame 62. A rim 204" is defined about the connection opening 230 and is configured to abut against the shoulder 65 of the lower frame 62 upon connection of the jaw set assembly 200". In the illustrated embodiment, the connection opening 230 has internal threads for a threaded connection to the lower frame, but other connection means may be utilized. The rim 204 includes at least one recess 205, four in the illustrated embodiment, configured to receive a portion of a lock rod 116 which helps to prevent inadvertent unscrewing of the jaw set assembly 200' as will be described hereinafter. The rim 204" also includes at least one notch 203, in the illustrated embodiment, a notch 203 adjacent to each recess 205, which is configured to receive a portion of a sensor rod 110 as described hereinafter.

A portion of each jaw 210" extends through the jaw opening 201. In the present jaw set assembly 200", the jaw shoulder 211" is narrower and is spaced from the jaw ring 206 with a spiral spring 224 or the like positioned between the shoulder 211" and the jaw ring 206. The jaw ring 206 retains the jaws 210" in the housing 202" but allows slight axial movement of the jaws 210" as described hereinafter. The opposite ends of the jaws 210" are engaged by a pair of biasing members 222 such that the jaws 210" are biased to the open position shown in FIG. 21. A cam member 208" is positioned within the jaws 210" and includes a tapered portion 207, a contact portion 209 and a forward extending portion 213. In the open position, the rear ends of the jaws 210" are axially aligned with the tapered portion 207 such that the rear ends are biased radially inward and the jaws 210" remain in the open position. Forward axial movement of the cam member 208" relative to the jaws 210"

causes the contact portion 209 to contact the rear ends of the jaws 210" which causes the jaws 210" to pivot and bring the forward ends of the jaws 210" radially inward.

In this exemplary jaw set assembly 200" which is configured for decapping, the cam member 208" and the jaws 210" are configured to initially move axially forward together such that the forward extending portion 213 can contact the cap (not shown) prior to pivoting of the jaws 210". Wave spring 228 extends between the barrel 214 and a wave spring collar 226 in contact with the rear ends of the jaws 210" such that the jaws 210" are urged forward. The jaws 210" do not move forward until movement of the cam member 208" based on the contact of the jaws 210" against the cam member 208" and the rearward force on the cam member 208". As such, the jaws 210" remain a given distance from the spiral spring 224. This will be the distance the cam member 208" and jaws 210" can move axially together before the jaws 210" begin to pivot, as explained below.

Axial movement of the cam member 208", with the jaws 210" and relative to the jaws 210", is controlled by a plunger rod 220 having a forward end 221 connected to the cam member 208". In the illustrated embodiment, the forward end 221 is press fit into connection with the cam member 208", but other connection methods, for example, a threaded connection, may alternatively be utilized. The barrel 214 is positioned in the housing 202' and defines a stepped through bore 215 through which the plunger rod 220 extends. A spring 218 is positioned in the stepped through bore 215 between a forward shoulder 217 defined by the barrel 214 and a shoulder 223 defined by the plunger rod 220 such that the plunger rod 220, and thereby the cam member 208", are biased rearward. The barrel 214 is secured in the housing 202" via a retaining ring 216 or the like.

Upon initial forward movement of the plunger rod 220, the cam member 208" will move forward. The jaws 210" will also move forward based on the bias of the wave spring 228 between the fixed barrel 214 and the moveable wave spring collar 226. The cam member 208" and jaws 210" will move together until the shoulder 211" contacts the spiral spring 224/retaining ring 206 at which point the jaws 210" will no longer be able to move forward and the cam member 208" will move forward relative to the jaws 210" such that the contact portion 209 contacts the rear ends of the jaws 210" and causes the forward ends of the jaws 210" to pivot radially inward.

The barrel 214 desirably closes the connection opening 230 except for the through bore 215 from which the plunger rod 220 extends. In this way, the jaw set assembly 200" provides a self-contained, interchangeable assembly with the actuating member, i.e. the plunger rod 220, easily accessible at the connection opening 230.

In each of the jaw set assemblies 200', 200", axial movement of the plunger rod 220 is effected by axial movement of the screw pusher 90. Forward movement of the screw pusher 90 will contact the plunger rod 220 and drive the plunger rod 220 forward against the bias of the spring 218. Upon retraction of the screw pusher 90, the spring 218 biases the plunger rod 220 rearward to the open positions illustrated in FIGS. 18 and 21.

A sensor assembly 120 is provided to control the length of the stroke of the screw pusher 90 and thereby the plunger rod 220. Referring to FIGS. 8-10, the sensor assembly 120 includes a plate 121 which is attached to frame members 47, 49 of the lower frame assembly 60. An optical rotational sensor 124 is secured on the plate 121 and is positioned to extend through the opening 125 such that it is aligned with the encoder ring 54. The optical rotational sensor 124 is configured to monitor the passage of the distinct teeth 56. Based on the passage of teeth 56, the sensor 124 itself, or a motor control board 130, may determine the speed, direction and angle of rotation. Based on this information, the length of the stroke generated by the lead screw 70 may also be determined.

As indicated above, the present hand tool 10 preferably is useable with interchangeable jaw set assemblies 200, 200', 200" having different configurations. As such, the stroke required for one jaw set assembly 200 may be different than for another jaw set assembly 200. To ensure a proper stroke, the present embodiment of the invention includes a jaw sensor assembly 100.

Referring to FIGS. 22-25, the jaw sensor assembly 100 of the present embodiment includes a body 102 including upper and lower shelves 101 and 111. The upper shelf 101 includes a pair of upper sensor rod slots 103 and the lower shelf 111 includes a pair of lower sensor rod slots 105 aligned with the upper slots 103. Each slot pair 103, 105 is configured to receive a respective sensor rod 110*a,b*. Each sensor rod 110*a,b* has a shaft 112 which terminates in a sensor contact pad 114 at one end and has a snap fit member 113 positioned adjacent thereto. The shafts 112 extend through the slots 103 and 105 with a spring 115 thereabout and extending between the shelves 101 and 111. The snap fit member 113 passes through the lower slot 105 and then snap fits relative to the lower shelf 111, thereby preventing downward movement of the sensor rod 110*a,b*.

A lock rod 116 extends along the rear of the body 102 parallel to the sensor rods 110*a,b*. The lock rod 116 has a notched end 118 and a contact end 119 with a groove 117 defined therebetween. An aperture 106 extends through the body 102 such that the lock rod groove 117 is aligned therewith. A lock button 107 is positioned along the front of the body 102 and includes a connector 108 that extends through the aperture 106 and connects to the lock rod 116 in the groove 117. A spring 109 extends between the upper shelf 101 and a shoulder about the groove 117 such that the lock rod 116 is biased forward.

Figure 25:
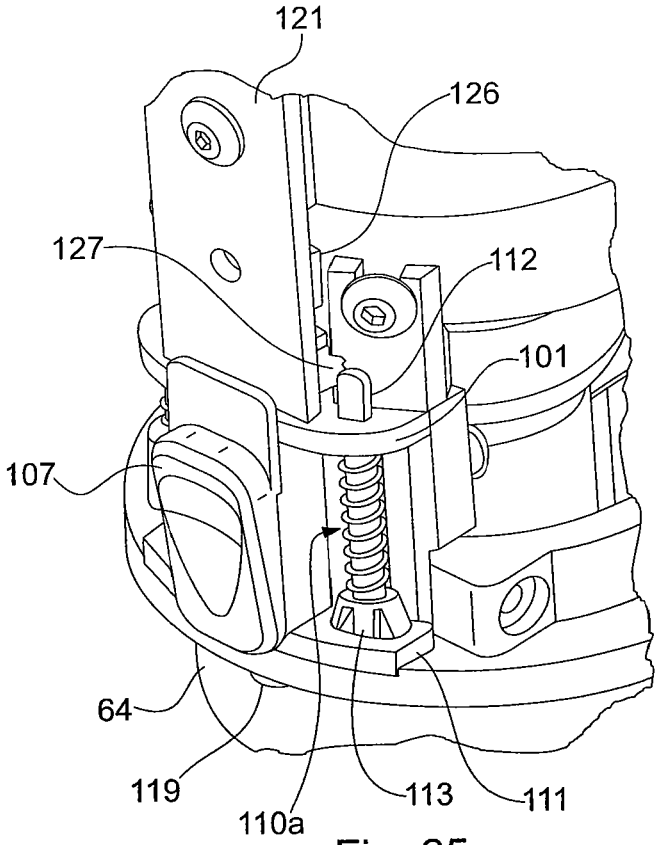
FIG. 25 is an expanded isometric view of a portion of the gearbox assembly of FIG. 9.

Referring to FIGS. 9, 10 and 25, the jaw sensor assembly 100 is attached to the lower frame assembly 60 such that the notched end 118 of the lock rod 116 extends behind the sensor plate 121 and engages an unlock member 126 which prevents movement of the lock rod 116 during an operation of the device. The shafts 112 of the sensor rods 110 extend adjacent to each side of the sensor plate 121 with each shaft 112 aligned with a corresponding axial movement sensor 127. Each axial movement sensor 127 is configured to sense the axial position of a respective sensor rod 110. At the opposite end, the contact end 119 of the lock rod 116 extends through the lock rod opening 69 such that the lock rod contact end 119 is beyond the shoulder 65. Similarly, each sensor contact pad 114 extends into a respective sensor rod opening 67 in the shoulder 65 and extends beyond the shoulder 65.

Referring to FIGS. 16, 19 and 25, operation of the jaw sensor assembly 100 will be described. As explained above, either of the housings 202', 202" may be attached to the lower portion 64 of the frame 62 until the rim 204 abuts the shoulder 65. As the jaw set housing 202', 202" is fully positioned about the lower portion 64 of lower frame 62, the lock rod contact end 119 is received within one of the recesses 205, thereby preventing inadvertent rotation of the housing 202', 202" in a reverse, removing direction. To remove the jaw set assembly 200, the lock rod 116 is retracted against the force of the spring 109 until the contact end 119 disengages from the recess. As explained above, if the device is in operation, engagement of the unlock member 126 with the notch 118 will prevent retraction of the lock rod 116.

The sensor rods 110*a* and 110*b* are configured to provide one or more sensing functions. In the present embodiment, one of the sensor rods 110*a* is configured to determine if a jaw set assembly 200 has been positioned on the housing 20. The other sensor rod 110*b* is configured to determine if the jaw set assembly is a crimping jaw set assembly 200' or a decapping jaw set assembly 200".

The contact pad 114 of sensor rod 110*a* is positioned next to the lock rod 116 such that it will not be aligned with a recess 205 or a notch 203 when the assembly 200' or assembly 200" is connected and the lock rod 116 is received in the recess 203. As such, the contact pad 114 will contact a portion of the rim 204, and will thereby be moved axially when either jaw set assembly 200', 200" is attached. The axial movement of the sensor rod 110*a* is detected by the respective axial movement sensor 127 and signals to the motor control board that a jaw set assembly 200' or 200" is attached.

The contact pad 114 of sensor rod 110*b* is positioned on the opposite side the lock rod 116 such that it will align with one of the notches 203 when the jaw set assembly 200" is connected and the lock rod 116 is received in the recess 203. As such, when a decapping jaw set assembly 200" is connected, the contact pad 114 will be received in the notch 203 and will not cause the sensor rod 110*b* to move axially, but instead it will remain in its default position. Since the rim 204 of the crimping jaw set assembly 200' does not include any notches, the contact pad 114 will contact the rim 204 and the sensor rod 110*b* will move axially. The axial movement of the sensor rod 110*b* is detected by the respective axial movement sensor 127 and signals to the motor control board that a crimping jaw set assembly 200' is attached. With no axial movement of sensor rod 110*b*, the motor control board determines that a decapping jaw set assembly 200" is attached. Other configurations may be utilized, for example, different depth notches, to further identify the jaw set assembly 200, for example, the size of the jaw set.

Knowing the configuration of the jaw set assembly 200, the appropriate stroke may be utilized. As explained above, in the illustrated embodiment, movement of the stroke of the screw pusher 90 forward or rearward is effected by the motor 42. Referring to FIG. 8, a motor control circuit board 130 is positioned within the housing assembly 20 and is in electrical communication between the motor 42, the activation button 80, a power control board 140, sensors 124 and 127 and unlock member 126. The power control board 140 has an electrical input 142. In the present embodiment, the electrical input 142 is configured for connection to an electrical cord 144 (see FIGS. 1-6), however, other power sources, for example, batteries, may be utilized. The power control board 142 is configured to determine when the hand tool 10 has been powered up, e.g. plugged in or turned on if an on/off switch is provided. Other functions of the power control board 142 will be described hereinafter.

Figure 26:
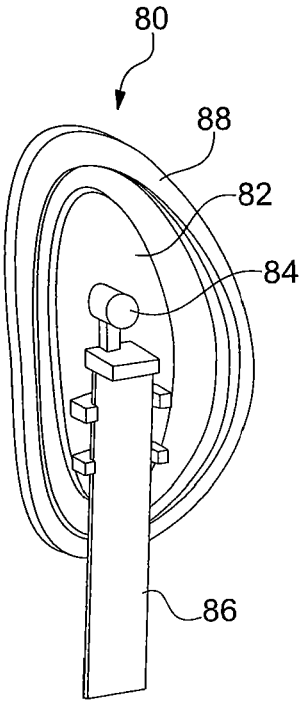
FIG. 26 is an isometric view of the activation button assembly of the electric hand tool of FIG. 1.
Figure 27:
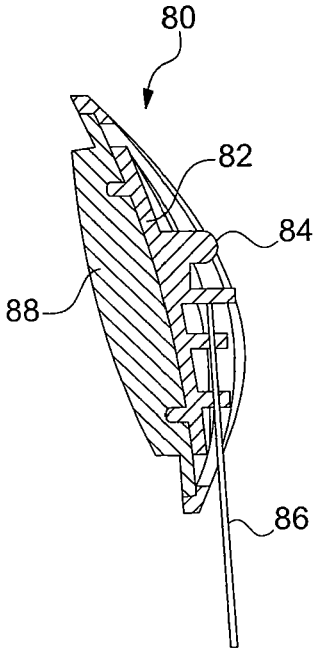
FIG. 27 is a cross-sectional view of the activation button assembly of FIG. 26.
Figure 28:
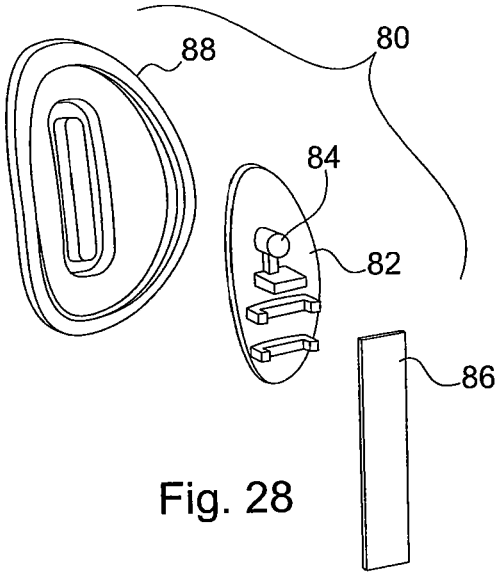
FIG. 28 is an exploded view of the activation button assembly of FIG. 26.

Referring to FIGS. 26-28, the activation button 80 includes a button member 82 with a contact member 84 extending therefrom. In the present embodiment, overmold assembly 88 is provided about the button member 82, but other configurations may be utilized. Referring again to FIG. 8, the activation button 80 is positioned in the housing assembly 20 such that the contact member 84 is aligned with a activation switch 132 on the motor control circuit board 130. A spring 86 extends from the button member 82 and is configured to be secured within the housing assembly 20 and urge the button member 82 to a non-contact position.

In general terms, upon power up of the hand tool 10, as detected by the power control board 142, the motor control circuit board 130 is configured to determine through sensors 127 if a jaw set assembly 200 is attached and if so, whether it is a crimping jaw set assembly 200' or a decapping jaw set assembly 200". If a jaw set assembly 200 is attached, the motor control circuit board 130 is configured to run the motor 42 in reverse during a 'homing' cycle, where the screw pusher 90 is drawn up into the unit until it reaches a home position. The home position may be identified by a limit switch (not shown) or by other means. When the activation button 80 is pressed, the motor control board 130 controls the motor 42 to drive the lead screw 70, thereby causing the screw pusher 90 to move forward which presses against the plunger rod 220 of the attached jaw set assembly 200, 200', 200" and causes the jaws 210 to close. As described above, the encoder ring 54 in the gearbox assembly 40 is used to monitor the length of the lead screw 70 stroke. Once the stroke is complete, the motor 42 is reversed and the screw pusher 90 is moved back to the home position by the lead screw 70, opening the jaw set.

The control board 130 preferably has predefined actuation depending on the type of jaw set assembly 200', 200" that is attached. For example, when a decapping jaw set assembly 200" is detected on the unit, the control board 130 may be configured to operate the motor for a maximum stroke length as precision is not required. Furthermore, the unit may give an indication of a decapping operation, for example, by lighting all of the indicator lights of the light indicator 35 described hereinafter.

Figure 29:
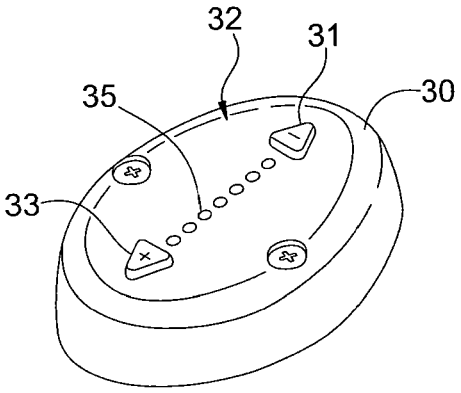
FIG. 29 is a top isometric view of the top cap assembly of the electric hand tool of FIG. 1.
Figure 30:
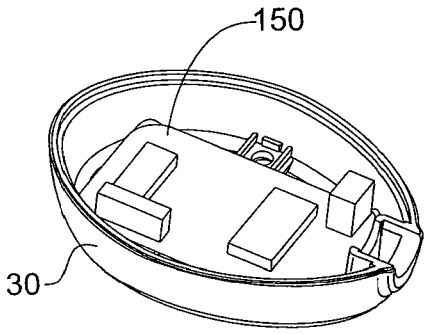
FIG. 30 is a bottom isometric view of the top cap assembly of FIG. 29.
Figure 31:
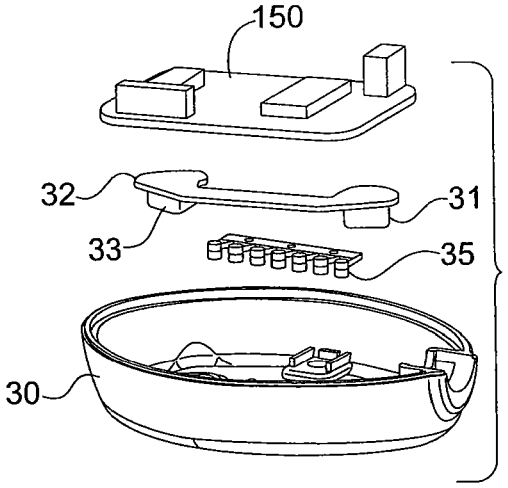
FIG. 31 is an exploded view of the top cap assembly of FIG. 29.

When a crimping jaw set assembly 200' is detected, the control board 130 is preferably configured to operate the motor 42 to achieve a predetermined stroke that is less than the maximum stroke length. In some instances, a predetermined stroke may be too long or too short. As such, the top cap 30 of the present embodiment of the invention is provided with a user stroke control input 32 as shown in FIGS. 29-31. The stroke control input 32 includes a pair of input buttons 31 and 33 which engage a stroke control board 150 which in turn is in communication with the motor control board 130. One of the input buttons 31 is configured to send a signal to the motor control board 130 to decrease the stroke while the other input button 33 is configured to send a signal to the motor control board 130 to increase the stroke. A light indicator 35 or the like may be provided in the top cap 30 and associated with the stroke control board 150 to provide a visual indication of the current length of the stroke, as adjusted. In an exemplary embodiment, the lights of the light indicator 35 will have different colors which indicate different stroke lengths. For example, a green light will indicate a shorter stroke length, a yellow light will indicate an average stroke length and a red light will indicate a longer stroke length. Other configurations of the lights may also be utilized. The stroke control board 150 may include a non-volatile ram configured to remember an increase or decrease in stroke for a given application such that the same stroke can be provided again.

Figure 32:
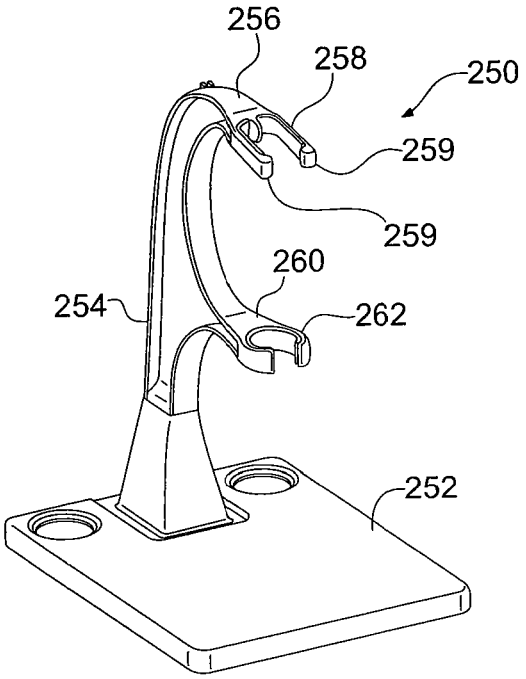
FIG. 32 is an isometric view of an exemplary tool holder for use with the electric hand tool of the current invention.
Figure 33:
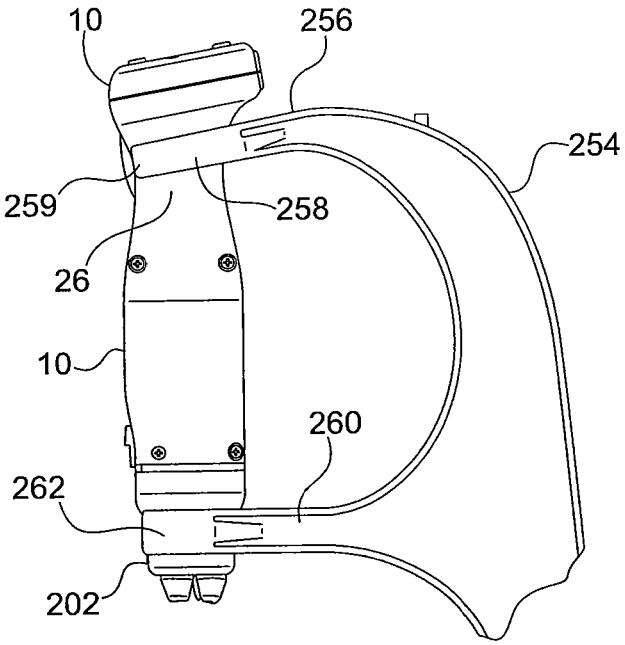
FIG. 33 is a partial isometric view of the tool holder of FIG. 32 with a tool supported thereby.

Referring to FIGS. 32 and 33, an exemplary tool holder 250 for use with the electric hand tool 10 will be described. The tool holder 250 includes a base 252 with an arm 254 extending therefrom. The arm 254 defines an upper holder 256 and a lower holder 260. The lower holder 260 includes a semi-circular, flexible grip 262 configured to receive and grasp the jaw set housing 202 as shown in FIG. 33. The upper holder 256 includes a forked grip 258 with a pair of tines that extend on the sides of the handle area 26 of the tool 10 as shown in FIG. 33. The end of each tine has a knob portion 259 such that the handle area 26 is releasably held in the forked grip 258. The hand tool 10 can be releasably stored in the tool holder 250, or may be maintained and used while in the tool holder 250. When stored in the tool holder 250, the hand tool 10 is in a proper orientation with the activation button 80 easily accessible. The hand tool 10 may additionally or alternatively be operated by a foot pedal (not shown) or the like connected to the hand tool 10.

While preferred embodiments of the invention have been shown and described herein, it will be understood that such embodiments are provided by way of to example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A hand tool for capping or decapping a cap from a container, the tool comprising: a housing assembly; a jaw set assembly including a jaw members and an actuating member configured to operate the jaw members, the jaw set assembly releasably connected to the housing assembly; a gearbox assembly positioned within the housing, the gearbox assembly including a motor, a lead screw rotated by the motor and a screw pusher engaged by the lead screw and moved axially based on rotation of the lead screw, the gearbox assembly configured to engage the actuating member with the screw pusher operatively engaging the actuating member of the jaw set assembly; and a sensor assembly configured to determine if the jaw set assembly is engaged with the housing assembly.

2. The hand tool according to claim 1 wherein the housing assembly has a central axis with a handle area defined about the central axis of the housing assembly and a motor actuation member located proximate the hand grip area.

3. The hand tool according to claim 2 wherein the hand grip area has a reduced circumference.

4. The hand tool according to claim 2 wherein the gearbox assembly has a drive axis that extends substantially coaxial with the central axis.

5. The hand tool according to claim 1 wherein the handle assembly includes a light indicator configured to display a visual indication of a current operating condition.

6. The hand tool according to claim 5 wherein the visual indication represents a presently set stroke length of the screw pusher.

7. The hand tool according to claim 5 wherein the visual indication represents a decapping operation.

8. The hand tool according to claim 1 further comprising a motor control board configured to control operation of the motor.

9. The hand tool according to claim 8 further comprising a stroke control input associated with the motor control board and configured to facilitate adjustment of the stroke length.

10. The hand tool according to claim 1 wherein the jaw set assembly is a crimping jaw set assembly, a decapping jaw set assembly or a screw cap chuck.

11. A hand tool for capping or decapping a cap from a container, the tool comprising: a housing assembly; a jaw set assembly including jaw members and an actuating member configured to operate the jaw members, the jaw set assembly releasably connected to the housing assembly; a gearbox assembly positioned within the housing, the gearbox assembly including a motor, a lead screw rotated by the motor and a screw pusher engaged by the lead screw and moved axially based on rotation of the lead screw, the gearbox assembly configured to engage the actuating member with the screw pusher operatively engaging the actuating member of the jaw set assembly; and a sensor assembly configured to sense the configuration of an engaged jaw set assembly and control the motor and a stroke of the lead screw based thereon.

12. The hand tool according to claim 11 wherein the sensor assembly is configured to sense whether the engaged jaw set assembly is a capping jaw set assembly or a decapping jaw set assembly.

13. A hand tool for capping or decapping a cap from a container, the tool comprising: a housing assembly; a jaw set assembly including jaw members and an actuating member configured to operate the jaw members, the jaw set assembly releasably connected to the housing assembly; a gearbox assembly positioned within the housing, the gearbox assembly including a motor, a lead screw rotated by the motor and a screw pusher engaged by the lead screw and moved axially based on rotation of the lead screw, the gearbox assembly configured to engage the actuating member with the screw pusher operatively engaging the actuating member of the jaw set assembly; and a lock rod extending from the housing assembly and configured to engage a recess in an engaged jaw set assembly, wherein the jaw set assembly threadably engages the housing assembly and engagement of the lock rod in the recess prevents unscrewing of the jaw set assembly.

14. The hand tool according to claim 13 wherein the lock rod is prevented form disengaging the recess during motor operation.

* * * * *